US010012188B2

(12) United States Patent
Kurz

(10) Patent No.: US 10,012,188 B2
(45) Date of Patent: Jul. 3, 2018

(54) PNEUMATIC EMERGENCY SHUT-OFF VALVE

(71) Applicant: SIEMENS AKTIENGESELLSCHAFT, Munich (DE)

(72) Inventor: Thomas Kurz, Filderstadt (DE)

(73) Assignee: Siemens Aktiengesellschaft, Munich (DE)

( * ) Notice: Subject to any disclaimer, the term of this patent is extended or adjusted under 35 U.S.C. 154(b) by 444 days.

(21) Appl. No.: 14/412,305

(22) PCT Filed: Jun. 19, 2013

(86) PCT No.: PCT/EP2013/062675
§ 371 (c)(1),
(2) Date: Dec. 31, 2014

(87) PCT Pub. No.: WO2014/005836
PCT Pub. Date: Jan. 9, 2014

(65) Prior Publication Data

US 2015/0159605 A1 Jun. 11, 2015

(30) Foreign Application Priority Data

Jul. 3, 2012 (DE) ..... 10 2012 211 530

(51) Int. Cl.
*F02M 63/02* (2006.01)
*F02M 37/00* (2006.01)

(52) U.S. Cl.
CPC .... *F02M 37/0023* (2013.01); *F02M 37/0047* (2013.01); *F02M 63/0215* (2013.01)

(58) Field of Classification Search
CPC ..... F16K 31/12; F16K 31/124; F16K 17/00; F02M 37/0023; F02M 37/0047; F02M 63/0215
USPC ..... 251/25, 30.01; 123/198 DB, 198 F, 123/198 D, 446, 456, 479
See application file for complete search history.

(56) References Cited

U.S. PATENT DOCUMENTS 4,492,191 A 1/1985 Aoki et al.
4,811,711 A * 3/1989 Stumpp ..... F02M 63/0215 123/198 DB

FOREIGN PATENT DOCUMENTS

DE 1823110 U 12/1960
DE 3115410 A 12/1982
RU 40402 U1 9/2004
RU 42593 U1 12/2004

* cited by examiner

*Primary Examiner* — Marina Tietjen
(74) *Attorney, Agent, or Firm* — Laurence Greenberg; Werner Stemer; Ralph Locher

(57) ABSTRACT

A drive device for generating a drive movement includes a consumer, a fuel tank, which is connected to the consumer through a fuel line, and a pneumatically operable emergency shut-off valve in the fuel line. The emergency shut-off valve shuts off the fuel line in a closed position and allows fuel to pass through in an open position. The device provides a greater level of safety, in that the emergency shut-off valve remains in its closed position, or even automatically shifts to the closed position, in the event of defective operation.

11 Claims, 1 Drawing Sheet

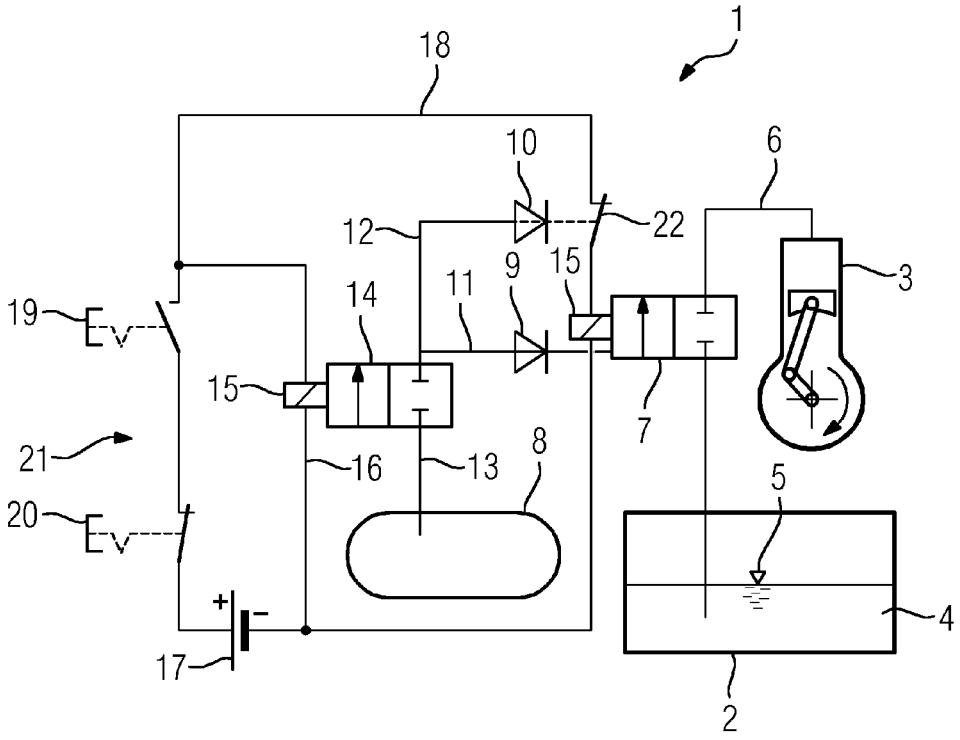
1
18
10
6
22
12
9
15
3
19
14
11
15
7
21
16
13
8
5
20
4
17
2

PNEUMATIC EMERGENCY SHUT-OFF VALVE

BACKGROUND OF THE INVENTION

Field of the Invention

The invention relates to an apparatus for protecting systems comprising a consumer, a fuel tank which is connected to the consumer via a fuel line and a pneumatically-actuatable emergency shut-off valve disposed in the fuel line, which in a closed position shuts off the fuel line and in an open position allows fuel to pass through the line.

Such an apparatus is already known in practice. Some locomotives operating the United States of America have emergency shut-off devices which can be actuated manually and operate purely mechanically. Such emergency shut-off devices have a control cable or a knee lever—or other valves.

In addition locomotives are known which are equipped on both of their sides with a switch. The switch disposed there triggers an engine shutdown facility, which—especially with diesel engines—is prone to faults and is not always certain to lead to the engine being shut down.

Further pneumatic fuel shut-off valves with electropneumatic preliminary control are known in practice. The previously known pneumatic emergency shut-off valves are however such that said valves automatically move into their open position in the absence of compressed air. This is useful for being able to recommission locomotives which have been parked for long periods of which the compressed air containers no longer have any compressed air. If the pneumatic emergency shut-off valves are in their open position the fuel tank continues to be connected to the consumer for example. This produces a safety gap in the overall system.

BRIEF SUMMARY OF THE INVENTION

The object of the invention is therefore to create an apparatus of the type stated at the start which provides comprehensive and seamless safety.

This object is achieved within the context of the invention by the emergency shut-off valve remaining in its closed position when not actuated or moving automatically into said position.

In accordance with the invention an apparatus with an emergency shut-off valve is provided which, if not actuated, by spring force for example, moves automatically into its closed position. In other words the emergency shut-off valve is closed when not actuated, i.e. when in its rest position. In this closed position the fuel line is closed off and thus the consumer is separated from the fuel tank. In this way enhanced safety is provided as part of the invention.

The consumer is for example a gas turbine, an internal combustion engine, especially a diesel engine, or any other internal combustion machine.

Advantageously the emergency shut-off valve is able to be connected via a compressed air line to a compressed air container. If the compressed air container is thus filled with compressed air, the emergency shut-off valve can have compressed air applied to it, wherein it is moved into or held in its open position. In this position the consumer is connected to the fuel tank, so that by the combustion of the fuel disposed in the fuel tank in the consumer a drive movement, for a locomotive for example, is able to be created.

In accordance with a preferred embodiment of the invention the emergency shut-off valve is additionally able to be actuated electrically or electromagnetically and is able to be connected via a shut-off valve circuit to an energy store. As well as a pneumatic activation of the emergency shut-off valve, an electrical actuation or in other words an electrical activation of the emergency shut-off valve is additionally possible as part of the invention. Thus the emergency shut-off valve has a coil which is excited when the emergency shut-off valve circuit is closed and generates a magnetic field which moves the emergency shut-off valve into its open position. In accordance with this advantageous development the emergency shut-off valve does not necessarily have to be actuated pneumatically. If for example the inventive apparatus is part of a locomotive and if the locomotive is completely decommissioned after being parked for long periods, its compressed air container will no longer have any compressed air. Starting the diesel engines would then not be possible since fuel tank and consumer are separated from one another by the emergency shut-off valve. In this case the energy store provides the necessary energy so that the emergency shut-off valve can be opened by means of this electrical emergency circuit. A battery, in other words a chemical accumulator or another type of energy store, is suitable here is as the energy store, which is configured to generate electrical energy and to feed a current into the shut-off valve circuit.

Advantageously a compressed air switch is disposed in the shut-off valve circuit, which is connected via a compressed air line to a pressure switch, wherein the compressed air switch, when the compressed air is applied to it, interrupts the shut-off valve circuit. In accordance with this advantageous development there is provision to shut down the electrical or electromagnetic actuation of the shut-off valve again when sufficient compressed air is available to be able to actuate the emergency shut-off valve solely pneumatically and thus hold said valve in its open position. The electromagnetic actuation is switched off pneumatically as part of this development so that the said switch-off can only be carried out if sufficient compressed air is available both for the actuation of the emergency shut-off valve and also for switching off the shut-off valve circuit. In operation the apparatus is thus actuated solely pneumatically. Through the pneumatic actuation an additional thermal load with an undesired temperature increase as a consequence is prevented. In addition solely pneumatically actuated valves are generally less sensitive to temperature fluctuations and high temperatures than valves which are activated electrically or electromagnetically. With electrical or electromagnetic actuation only an electrical emergency actuation (auxiliary actuation) is involved as part of the invention.

In accordance with a preferred embodiment emergency shut-off valve and compressed air switch are connected via a common compressed air line section to a compressed air container, wherein a preliminary control valve is disposed in the common compressed air line section. The preliminary control valve can for example allow the connection between compressed air container and emergency shut-off valve but can also interrupt it. If the preliminary control valve interrupts the said connection neither a pneumatic actuation of the emergency shut-off valve nor a pneumatic actuation of the compressed air switch is possible. The consequence of this is that the shut-off valve circuit is not interrupted and the emergency shut-off valve can thus be actuated electrically or electromagnetically. In the absence of pneumatic and electrical or electromagnetic actuation the emergency shut-off valve is moved within the context of the invention into its closed position so that the fuel tank is separated from the consumer.

In accordance with a preferred embodiment the preliminary control valve is able to be actuated electrically or electromagnetically. To this end the preliminary control valve is connected for example via a preliminary control valve circuit to an energy store, so that electrical or electromagnetic actuation of the preliminary control valve is made possible.

Advantageously start switches for closing and interrupting the preliminary control valve circuit and/or a shut-off valve circuit are provided as part of the invention. With the aid of the start switch for example the preliminary valve circuit can be closed, so that the coil of the preliminary control valve is excited and moves said valve into its open position. In the open position the compressed air switch and the pneumatically actuatable emergency shut-off valve are connected to the pressure container filled with compressed air, so that the emergency shut-off valve is actuated pneumatically and the shut-off valve circuit can be interrupted.

As part of the invention just one start switch can be provided. By contrast to start switches provided for example, which are each disposed in one of the two driver's cabs of a locomotive.

As well as start switches it is also possible in accordance with the invention to provide emergency shut-off switches which are disposed for example in the side area of a locomotive or in its engine compartment, into which the apparatus in accordance with the present invention is installed. The emergency shut-off switches serve to interrupt the preliminary valve circuit and/or the shut-off valve circuit. In this way the preliminary valve is moved into its closed position, so that a pneumatic actuation of the emergency shut-off valve is no longer possible. Said valve is therefore, in the absence of electrical or electromagnetic actuation, moved into its closed position. Fuel tank and consumer are then separated from one another. An electrical or electromagnetic actuation of the emergency shut-off valve is not possible because of the disconnection of the shut-off valve circuit after actuation of the emergency shut-off switch.

The invention further relates to a rail vehicle with an apparatus in accordance with the invention as explained above.

BRIEF DESCRIPTION OF THE DRAWING

Further expedient embodiments and advantages of the invention are the subject matter of the description of an exemplary embodiment of the invention given below, which refers to the FIGURE of the drawing, in which the FIGURE shows an exemplary embodiment of the inventive apparatus.

DESCRIPTION OF THE INVENTION

The single FIGURE of the drawing shows an exemplary embodiment of an inventive apparatus 1 having a fuel tank 2 and also a diesel engine 3 as consumer. The fuel tank 2 is filled with a fuel 4, wherein the fill level of the fuel tank 2 is detected by a float 5 and is displayed in the driver's cab of a locomotive by a signal transmission means not shown in the FIGURE.

The diesel engine 3 is connected via a fuel line 6 to the fuel tank 2. An emergency shut-off valve 7 is disposed in the fuel line 6. The emergency shut-off valve 7 shown involves a two-way valve with a closed rest position. In other words the emergency shut-off valve 7, in the absence of actuation, either moves into its closed position shown in the FIGURE or remains in said position. If the emergency shut-off valve 7 is in its shown closed position, the connection between diesel engine 3 and fuel tank 2 is interrupted. The safety requirements imposed on the apparatus are thus fulfilled within the framework of the invention. The emergency shut-off valve 7 shown in the FIGURE involves a pneumatically-actuatable emergency shut-off valve 7, wherein at the same time an electrical or electromagnetic emergency actuation is possible, which will be discussed in greater detail later.

The apparatus 1 further comprises a compressed air container 8, which can be connected to a pneumatic control connection 9 of the emergency shut-off valve 7 and also to a compressed air switch 10. The pneumatic control connection 9 is connected for this purpose via a first compressed air connection 11 and the compressed air switch via a second compressed air connection 12 to the compressed air container 8. In this case a compressed air line section 13 common to both connections is embodied, in which a preliminary control valve 14 is disposed. The preliminary control valve 14 is able to be actuated electrically and in this case electromagnetically, wherein for electromagnetic actuation for example a coil 15 of the preliminary control valve must be excited. For its electrical or electromagnetic actuation the emergency shut-off valve 7 likewise has a coil 15. The coil 15 of the preliminary control valve 14 is connected via a preliminary control valve circuit 16 to a battery 17 as energy store. The coil 15 of the emergency shut-off valve 7 is connected via a shut-off valve circuit 18 to the same battery 17. A start switch 19 is connected into the shut-off valve circuit 18 and also into the preliminary control valve circuit 16, which is disposed in the driver's cab of a locomotive. A second start switch not shown in the FIGURE is connected in parallel to the start switch 19 and is disposed in the other driver's cab of the locomotive. In addition for example six emergency-off switches 20 are provided which, like the start switches 19, serve to interrupt and close the shut-off valve circuit 18 and the preliminary control valve circuit 16. Two emergency-off switches are disposed in the driver's cabs, two further switches outside on the side wall and finally two in the engine compartment. In order to be able to interrupt both circuit 16 and 18 simultaneously with the same switches 19, 20, shut-off valve circuit 18 and preliminary control valve circuit 16 have a common branch 21, in which the said switches 18 and 20 are disposed.

The compressed air container 8 can be filled with compressed air when the diesel engine 3 is running via a compressor of the rail vehicle not shown in the FIGURE. In this case the compressor is driven during operation by the diesel engine 3.

To decommission the rail vehicle the diesel engine 3 is switched off. Subsequently the preliminary control valve 14 is moved into its closed position shown in the FIGURE by actuation of a start switch 19 in the driver's cab. Thus the pneumatic actuation of the emergency shut-off valve 7 is dispensed with. Since by opening the shut-off valve circuit 18 and the preliminary control valve circuit 16 with the aid of the start switch 19 an electromagnetic actuation of the emergency shut-off valve is also no longer possible, this is moved automatically for example into its closed position by a spring not shown in the FIGURE, so that the diesel engine 3 is disconnected from the fuel tank 2 as prescribed. The closed position is therefore at the same time the rest position of the emergency shut-off valve 7.

To interrupt the emergency shut-off valve circuit 18 the compressed air switch 10 interacts with a switch 22 which is disposed in the shut-off valve circuit 18. If compressed air is applied to the compressed air switch 10, the compressed air switch 10 opens the switch 22. This ensures that the shut-off valve circuit 18 is interrupted and thus that the coil 15 of the emergency shut-off valve 7 is no longer excited. In this way heating up of the coil 15 and of the emergency shut-off valve 7 by the coil 15 and additionally an unwanted consumption of energy can be avoided.

To start the locomotive the start switch 19 in one of the driver's cabs is actuated. Thus both preliminary control valve circuit 16 and also shut-off valve circuit 18 are closed. The battery 17 excites the coil 15 of the preliminary control valve 14 so that said valve is moved into its open position. If compressed air is present in the compressed air container. The compressed air switch 10 is actuated, through which the shut-off valve circuit 18 is interrupted. The emergency shut-off valve 7 is thus moved solely pneumatically into its open position. After the locomotive has been standing for long periods of time all compressed air can have escaped from the compressed air container 8. Thus no compressed air is available within the meaning of the invention. The emergency shut-off valve 7 can therefore not be actuated pneumatically. Within the context of the invention however this does not result in the opening of the shut-off valve circuit 18 by the compressed air switch 10 or the switch 22. In other words the coil 15 of the emergency shut-off valve 7 remains connected to the battery 17 and is therefore excited. The result is electromagnetic actuation of the emergency shut-off valve 7, which is moved into its open position by this action. Now the diesel engine 3 can be started, which in turn drives the compressor for providing compressed air in the compressed air container 8. If the compressed air container 8 is sufficiently filled with compressed air this results in pneumatic actuation of compressed air switch 10 and of the emergency shut-off valve 7, wherein the connection between the coil 15 of the emergency shut-off valve 7 and the battery 17 is interrupted by opening the switch 22. Now the emergency shut-off valve 7 will be actuated solely pneumatically and thus practically loss-free.

The invention claimed is:

1. An apparatus for protecting systems with a consumer, a fuel tank, and a fuel line connecting the consumer to the fuel tank;

the apparatus comprising:

an emergency shut-off valve disposed in the fuel line, said emergency shut-off valve having a closed position in which the fuel line is closed and an open position in which fuel is allowed to pass through the fuel line, said emergency shut-off valve, in the absence of actuation, remaining in the closed position or automatically moving into the closed position; and wherein said emergency shut-off valve is a combined pneumatically actuated and electrically and/or electromagnetically actuated valve, said emergency shut-off valve having an electrically actuated coil and including an electrical shut-off valve circuit connected to an electrical energy storage device.

2. The apparatus according to claim 1, wherein said emergency shut-off valve is connected via a compressed air line to a compressed air container.

3. The apparatus according to claim 1, which comprises a compressed air switch disposed in said shut-off valve circuit and connected via a compressed air line to a compressed air container, said compressed air switch interrupting said shut-off valve circuit upon pneumatic actuation.

4. The apparatus according to claim 3, wherein said emergency shut-off valve and said compressed air switch are connected via a common compressed air line section to the compressed air container, and comprising a pilot control valve disposed in said common compressed air line section.

5. The apparatus according to claim 4, wherein said pilot control valve is an electrically or electromagnetically actuated valve.

6. The apparatus according to claim 5, which comprises an energy storage device connected via a pilot control valve circuit to said pilot control valve for its actuation.

7. The apparatus according to claim 6, which comprises start switches for closing and interrupting said pilot control valve circuit and/or a shut-off valve circuit.

8. The apparatus according to claim 7, which comprises at least one emergency-off switch connected in said pilot control valve circuit and/or in said shut-off valve circuit.

9. The apparatus according to claim 1, which comprises at least one emergency-off switch connected in a pilot control valve circuit and/or in a shut-off valve circuit.

10. In a system having a consumer, a fuel tank, a fuel line connecting the consumer to the fuel tank, and a shut-off valve for shutting off a fuel supply from the fuel tank to the consumer, a protection apparatus comprising:

the shut-off valve being a pneumatically-actuated emergency shut-off valve disposed in the fuel line, said shut-off valve having a closed position in which the fuel line is closed and an open position in which fuel is allowed to pass through the fuel line, said emergency shut-off valve being a normally-closed valve which, absent an actuation thereof, remains in the closed position or automatically assumes the closed position; and wherein said emergency shut-off valve is combined pneumatically actuated or electrically and/or electromagnetically actuated valve, said shut-off valve including an electrically actuated coil and having an electrical shut-off valve circuit connected to an electrical energy storage device.

11. A rail vehicle, comprising an apparatus according to claim 1.

* * * * *